US006045008A

United States Patent [19]

González Fernández et al.

[11] Patent Number: 6,045,008

[45] Date of Patent: Apr. 4, 2000

[54] FLUID PUMP DISPENSER

[75] Inventors: Xavier González Fernández; Pedro Parés Montaner; Victor Ribera Turró, all of Barcelona, Spain

[73] Assignee: Calmar-Monturas, S.A., Barcelona, Spain

[21] Appl. No.: 09/271,239

[22] Filed: Mar. 17, 1999

[51] Int. Cl.[7] ..... F04B 53/12

[52] U.S. Cl. ..... 222/153.13; 222/321.9; 222/321.7

[58] Field of Search ..... 222/153.13, 321.3, 222/321.7, 321.8, 321.9

[56] References Cited

U.S. PATENT DOCUMENTS

| | | |
|---|---|---|
| 3,187,960 | 6/1965 | Gorman . |
| 3,489,322 | 1/1970 | Ayres . |
| 3,500,761 | 3/1970 | Clevenger et al. . |
| 3,608,788 | 9/1971 | Tanaka . |
| 3,724,726 | 4/1973 | Susuki et al. . |
| 4,155,489 | 5/1979 | Steiman . |
| 4,162,746 | 7/1979 | Anderson et al. . |
| 4,434,916 | 3/1984 | Ruscitti et al. . |
| 4,991,746 | 2/1991 | Schultz . |
| 5,401,148 | 3/1995 | Foster et al. . |
| 5,615,806 | 4/1997 | Grothoff . |

*Primary Examiner*—Steven O. Douglas
*Attorney, Agent, or Firm*—Watson Cole Grindle Watson, P.L.L.C.

[57] ABSTRACT

A fluid pump dispenser has a pump body including a pump cylinder defining a pump chamber with a valve controlled product inlet passage leading to the chamber, a manually reciprocable pump plunger having a hollow stem defining a discharge passage leading from the chamber, a pump piston mounted on the inner end of the stem for relative sliding movement, the body having a plunger return spring for biasing the plunger into a raised position, the piston being limited for relative sliding movement between discharge open and closed positions, the piston having an annular projection defining a discharge valve seated in an annular groove of a plug element fixedly mounted to the stem at its inner end. A lost-motion effect is created between the piston and the stem which closes the discharge valve during the pressure stroke and opens the discharge during the intake stroke. The plunger is capable of being locked in up and down positions, an outer surface of the plug element sealing the inlet passage closed in the plunger lock-down position.

9 Claims, 3 Drawing Sheets

FLUID PUMP DISPENSER

BACKGROUND OF THE INVENTION

This invention relates to a fluid pump dispenser of a type having a pump body with a pump cylinder defining a pump chamber, and a valve-controlled product inlet passage leading to the chamber. A manually reciprocable pump plunger has a hollow stem defining a valve controlled discharge passage leading from the chamber to a discharge spout on an outer end of the stem, and a pump piston mounted on an inner end of the stem for relative sliding movement, the body having a plunger return spring for biasing the plunger into a raised position.

Fluid pump dispensers generally of the aforementioned type are known, although many of the known dispensers have certain disadvantages in that while offering a high level of technical improvements are often costly to produce and assemble while others, if economical, have significantly reduced technical advantages.

U.S. Pat. No. 5,615,806 discloses a plunger lock-up dispenser which operates by manually depressing a plunger/spout for lowering a hollow plunger stem to which a pump piston is attached thereby pressurizing primed liquid in the pump chamber defined by a pump cylinder of the dispenser body. A piston return spring located within the pump chamber extends between the piston and a throat portion of the pump body and forms a ball cage or an inlet ball check valve at the throat portion. The piston is mounted for limited sliding movement on the stem such that during the pressure stroke the piston uncovers discharge ports in the stem permitting fluid under pressure to be discharged through the discharge passage and spout. A quantity of product is dispensed from the chamber upon a full stroke of the piston, the quantity being in proportion to the length of the piston stroke. On the upstroke the piston returns to its raised position under the influence of the spring thereby expanding the chamber and reducing the chamber pressure causing product to be suctioned into the chamber through the open inlet valve from the liquid container to which the pump dispenser is mounted.

As in all manually operated dispensers the chamber must be primed with product to displace air in the chamber. Air is initially evacuated by stroking the plunger. However with such a prior art structural arrangement the compressible air in the chamber oftentimes causes the stem and piston to travel in unison without uncovering to the discharge ports for evacuating the chamber air until the end of the downstroke at which the stem travels slightly downwardly at the bottom end of the piston stroke for uncovering the discharge ports. On the return stroke the ports are closed and product is drawn into the expanding chamber via the unseated inlet ball check valve.

Such dispensers are principally designed to dispense liquid soaps and the like, a fluid of average viscosity, although on many occasions attempts to proportion low viscosity fluids fail, due to the fact that the nature of the seals in the seal-tight areas is relatively imperfect. Moreover, satisfactory results are difficult to achieve for dispensing high viscosity fluids, or variable (gel type) viscosity fluids, given that widespread use of such fluids is relatively recent and the inner passages of the pump dispenser are not adapted to them.

SUMMARY OF THE INVENTION

It is generally the objective of the present invention to overcome these disadvantages. The dispenser according to the invention provides for a plug element fixedly mounted to the piston stem at its inner end, the piston being mounted on the inner end of the stem for relative sliding movement, the piston having an annular depending projection defining a discharge valve seated in a confronting annular groove on the plug element. Relative sliding between the stem and piston during the pressure stroke opens the discharge exposing an annular gap on a downstream side of the plug element in open communication with the interior of the hollow stem defining the discharge passage. The need for differently sized discharge ports is therefore avoided thereby facilitating the dispensing of high viscosity fluids with good results.

The pump dispenser according to the invention likewise provides for plunger lock-up and plunger lock-down. In the latter condition an annular seal on the plug element sealingly engages a constricted inner diameter at the bottom of the chamber for positively sealing the inlet passage closed during shipping and storage and other periods of non-use.

Other objects, advantages and novel features of the invention will become more apparent from the following detailed description of the invention when taken in conjunction with the accompanying drawings.

DETAILED DESCRIPTION OF THE INVENTION

Figure 1:
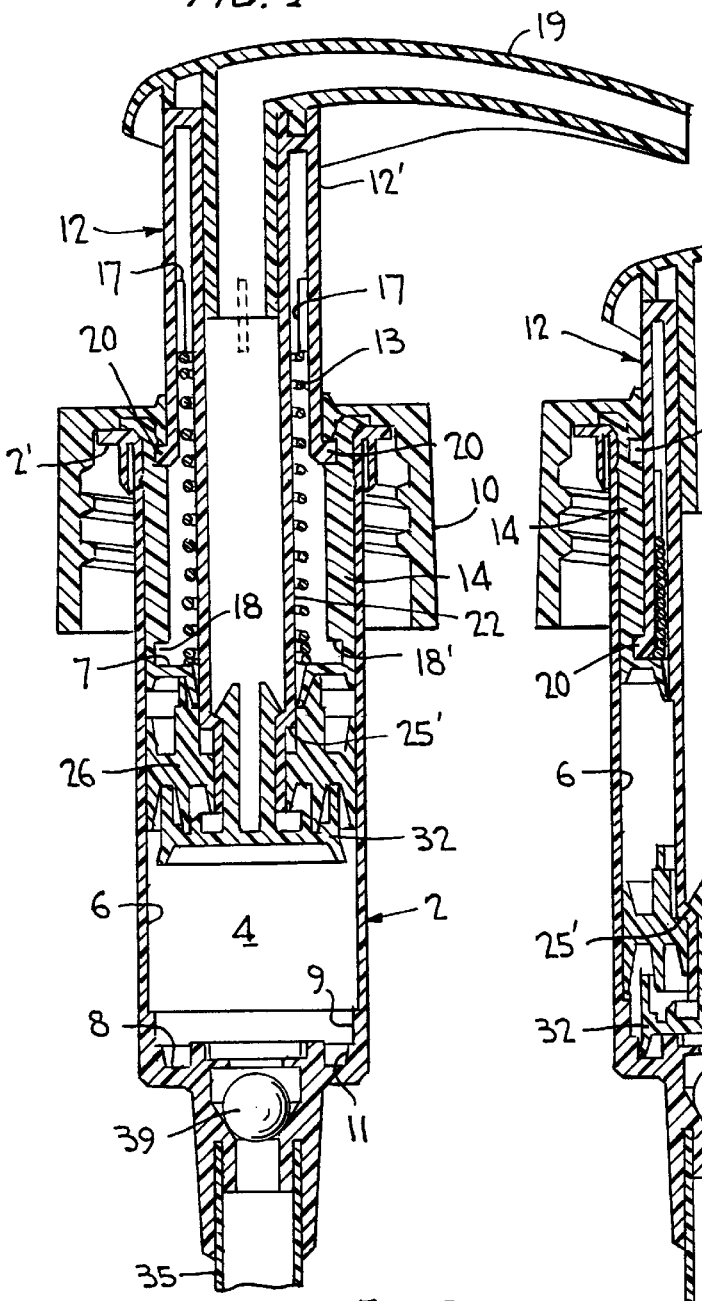
FIG. 1 is a vertical sectional view of the fluid pump dispenser according to the invention shown in a fully raised and plunger lock-up position.
Figure 2:
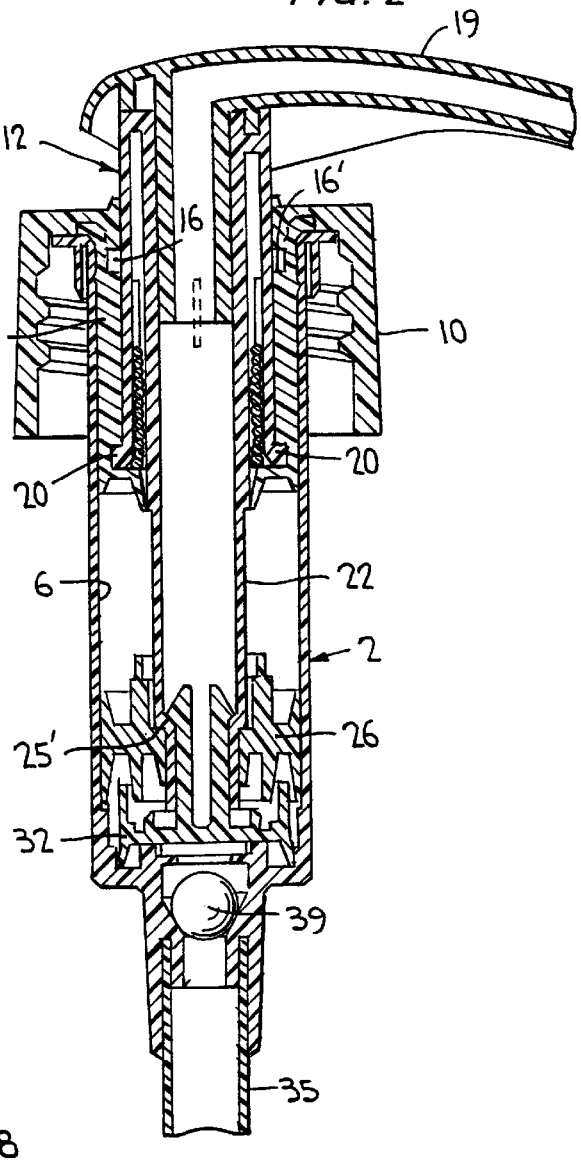
FIG. 2 is a view similar to FIG. 1 with the plunger shown in its fully lowered and plunger lock-down position.

The fluid dispenser of the invention, shown in FIGS. 1 and 2, comprises a pump body 2 which includes a pump cylinder defining a pump chamber 4 having an inner surface 6 and a bottom wall 8. The pump body is attached to a conventional closure cap 10 for mounting the dispenser to a container (not shown) of product to be dispensed. The inner diameter of the chamber is constricted as at 9, and an annular tapered section 11 is formed around bottom wall 8, which functions in a manner to be described in detail below.

The dispenser has a manually reciprocable pump plunger 12 with a hollow stem 22, a conventional spout 19 being mounted at the upper end of the stem. A plunger return spring 13 surrounds the stem external to the pump chamber and extends between suitable ribs 17 or the like on the inner surface of the plunger skirt and an inner flange 7 of an inner liner 14 fixedly mounted within the pump body as its flange 14' (FIGS. 8, 9) overlies upper external flange 2' of the pump body.

The plunger return spring comprises a "dry" spring as it is external to the pump chamber and therefore is not wetted by the liquid to be dispensed. This avoids any compatibility problems between the return spring and the liquid product as well as any interference with the product flow. The spring functions in the normal manner to return the plunger to its fully raised position of FIG. 1 from its fully lowered position of FIG. 2 during plunger reciprocation.

Figure 8:
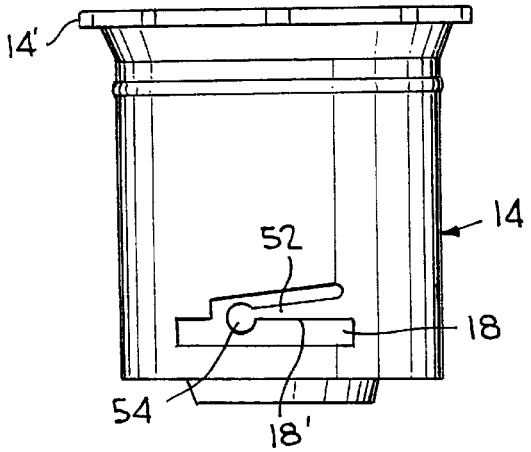
FIG. 8 is a side view of an inner liner, at an enlarged scale, fixed within the pump body and shown in vertical section in FIGS. 1 and 2.
Figure 9:
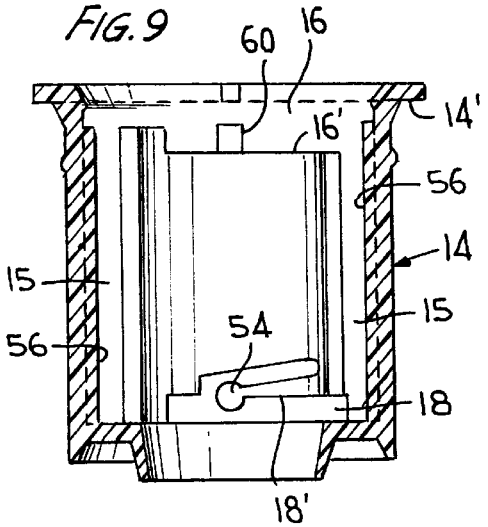
FIG. 9 is a vertical sectional view of the liner of FIG. 8.

Inner liner 14, of the type shown in FIGS. 8, 9, or inner liner 14A of the type shown in FIGS. 10 to 13, is fixedly mounted within the pump body. The liner has a pair of opposed axial grooves 15, an upper circular groove section 16 and a lower circular groove section 18. Upper groove section 16 present a stop shoulder 16', and lower groove section 18 presents a stop shoulder 18'.

Figure 7:
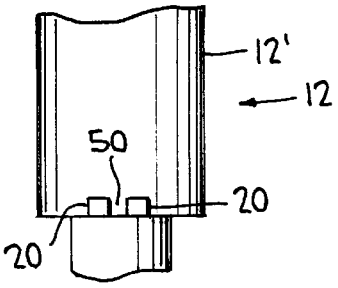
FIG. 7 is a side elevational view of the plunger, partly broken away.
Figure 10:
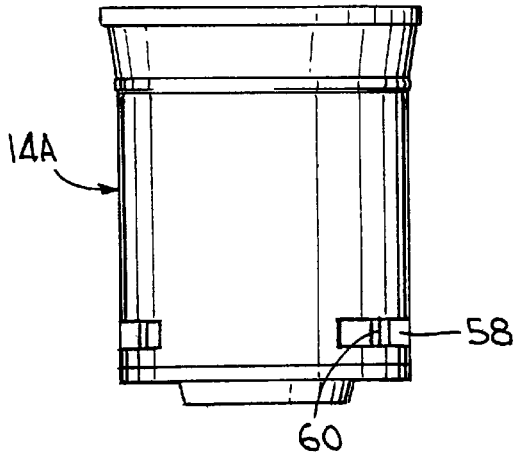
FIG. 10 is a side view of a liner according to another embodiment of the invention.
Figure 11:
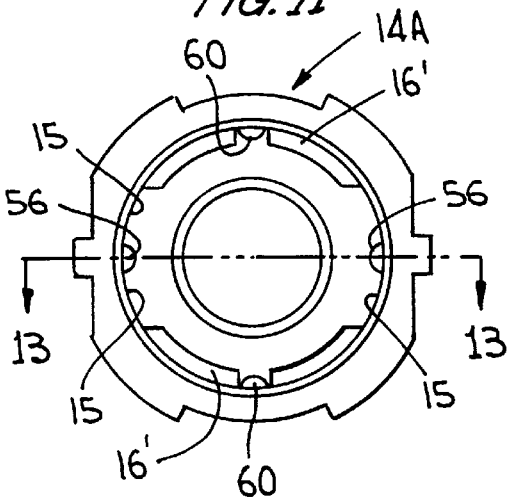
FIG. 11 is a top plan view of the liner of FIG. 10.
Figure 12:
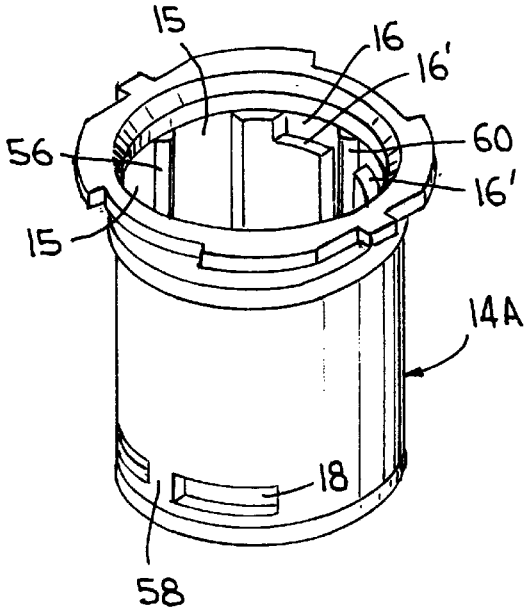
FIG. 12 is a perspective view of the FIG. 10 liner.
Figure 13:
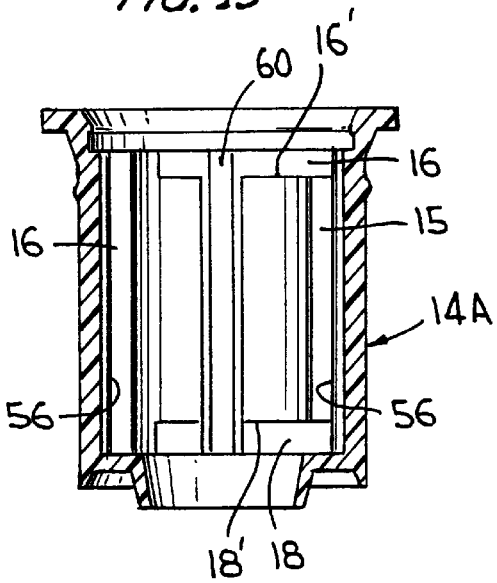
FIG. 13 is a vertical sectional view of the liner taken substantially along line 13—13 of FIG. 11.

Plunger 12 is capable of rotation about its central axis relative to pump body 2, the plunger skirt 12' having a pair of opposing radially outwardly extending lugs 20 (FIG. 7) spaced a predetermined distance apart to define a notch or space 50 therebetween. It should be noted that FIG. 7 illustrates only one of such pair of lugs 20, the opposing pair being located on the opposite side of the plunger skirt.

When the plunger is in its fully raised position it can be manually rotated so that lugs 20 move along upper circular groove section 16 until the opposing lugs are aligned with axial grooves 15. The plunger can therefore be depressed for carrying out a dispensing operation in the normal manner, the lugs sliding along and being guided by the opposing pair of axial grooves 15. The plunger is capable of being locked in its up position by rotating the plunger until its lugs engage stop shoulders 16' which thereby arrests any attempt to depress the plunger. Otherwise the plunger is capable of being locked in its down position by rotating the plunger until its lugs are aligned with axial grooves 15, depressing the plunger while in such alignment, and rotating the plunger until its lugs are out of alignment with grooves 15 and underly stop shoulders 18'. Engagement between the lugs and stop shoulders 18' locks the plunger in its down position shown in FIG. 2.

Figure 3:
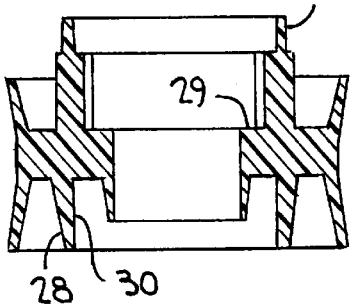
FIG. 3 is a vertical sectional view of the hollow pump piston, at a slightly enlarged scale.
Figure 5:
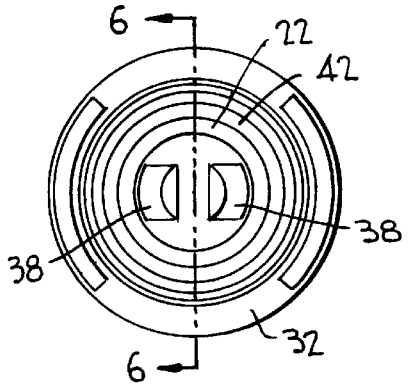
FIG. 5 is a view taken substantially along the line 5—5 of FIG. 4.
Figure 4:
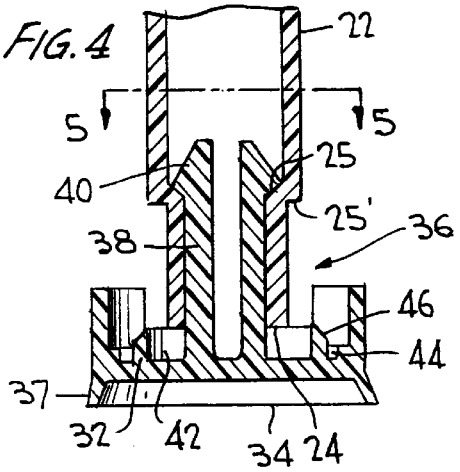
FIG. 4 is a vertical sectional view of the plug element fixedly attached to the lower end of the hollow piston stem.

Hollow stem 22 of the plunger has an inner terminal end edge 24 (FIG. 4), and the inner end section of the stem is constricted presenting an inner shoulder 25 and an outer shoulder 25'. Hollow piston 26, shown in detail in FIG. 3, surrounds the inner end section of the stem, and is formed with an inner shoulder 29 which, as shown in FIGS. 1 and 2, confronts outer shoulder 25' on the stem. The piston is mounted to the stem for axial sliding movement relative thereto between a discharge open position of FIG. 2 and a discharge closed position of FIG. 1, the upper limit of the piston being defined by abutting shoulders 25', 29.

The piston has an annular depending projection 28 with an inner cylindrical surface 30.

Plug element 32 is fixedly attached to the inner end section of the stem, the plug having a flat outer surface 34 facing bottom end 8 of the chamber, and having an opposing side 36. An annular seal skirt 37 is formed on surface 34 and extends in both radial and downward directions as shown. Seal 37 tightly engages tapered section 11 of inner surface 6 of the chamber when the plunger is in its fully lowered, lock-down position of FIG. 2. Thus any leakage through an unseated inlet ball check valve 39 from the pump during shipping, storage or other periods of non-use, is substantially avoided.

Plug element 36 is fixedly attached in place by the provision of a pair of opposing spring legs 38 having snap beads 40 at the inner end thereof which engage inner shoulder 25.

As shown in FIGS. 9 and 11 to 13, each of the opposing axial grooves 15 has an axial elongated bead 56 substantially centered therein. Thus when the plunger is rotated until its opposing lugs are in axial alignment with groove 15 to unlock the plunger to facilitate dispensing, one of the pair of lugs 20 of each opposing pair will abut against bead 56 which signals the operator that the plunger is in an operable position. Further movement by the operator of the plunger in the same direction of turning will cause the first lug of each pair to override confronting bead 56 whereupon the bead will extend into notch 50 to positively retain the plunger in its unlocked, dispensing position. During the process of overriding the bead, which now is received within notch 50, the operator is able to feel such a movement and will hear a slight clicking sound signaling the operator of the plunger unlocked position.

In a similar fashion, a bead section 60 (FIG. 9) is formed at the interior of liner 14 adjacent stop shoulder 16'. Thus, when the plunger is rotated in its raised position to place the lugs out of alignment with the axial groove 15 and overlying stop shoulders 16', the forward one of the lugs of each pair will engage bead section 60 and, with a slight further turning rotative movement by the operator, the lug will override the bead sections and come to rest with the bead section extending into notch 50. Again, the operator can both feel this lug/bead section engagement and will hear an audible clicking sound both confirming that the plunger is locked in its up position.

To signal the operator that the plunger is locked in its down position as intended, thickened opposing wall sections of the liner (which effectively define the opposing stop shoulders 16', 18') are provided with a through opening to define bottom groove section 18. And, a resilient arm 12 is formed to define a bead 54 associated with each opposing bottom stop shoulder 18'. Bead 54 functions in the same manner as bead section 60 when the plunger is rotated such that its lugs expand bead 54 which extends into the notch 50 for both tactilely and audibly confirming to the operator that the plunger is in its lock-down position.

Otherwise liner 14A, which is the same as liner 14 in respect of elongated beads 56, is provided with a pair of opposing elongated beads 60 which are substantially centered both with respect to upper stop shoulder 16' and with respect to lower stop shoulder 18'. Beads 60 span the cutouts forming bottom grooves 18 such that interruptions 58 are provided during the molding process.

In operation, with the plunger in its fully raised position and unlocked, its lugs 20 are rotated into alignment with opposing axial grooves 50, the plunger head is manually depressed as in any normal manner for pressurizing product during plunger reciprocation located in the pump chamber. During each downward pressure stroke of the plunger, the piston shifts upwardly relative to the plunger stem from its FIG. 1 to its FIG. 2 position as limited by abutting stops 25', 29. The frictional engagement between the piston and inner surface 6 of the pump cylinder facilitates the lowering of the plunger stem slightly ahead of a lowering of the piston thereby creating a lost-motion effect.

Figure 6:
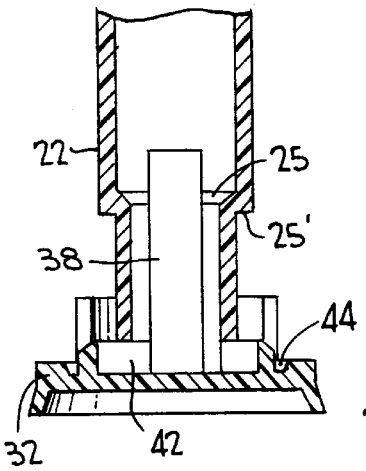
FIG. 6 is a sectional view taken substantially along the line 6—6 of FIG. 5.

Annular projection 28 of the piston defines a discharge valve which is seated in a confronting annular groove 44 located on the plug element. Side 36 of the plug element defines an annular gap 42 in communication with the interior of the hollow stem which forms a discharge passage via spaces between spring legs 38 (see FIG. 6). Thus during the lost-motion between the piston and stem during each return suction stroke of the piston, the discharge valve is closed as projection 28 seats tightly within its groove 44 thereby permitting product to be suctioned into the pump chamber via dip-tube 35 and the unseated inlet ball check valve in the normal manner. A slight frictional drag occasioned between the piston and the inner surface 6 of the pump body facilitates axial movement in a return direction of the piston stem slightly ahead of the piston.

The plunger is locked in its up position by manual rotation placing lugs 20 out of alignment with grooves 15 and overlying upper stop shoulders 16' with the lugs being "clicked" in place. Otherwise the plunger may be locked in its full down position of FIG. 2 by rotating the plunger until the lugs first align with grooves 15 and then are misaligned and underly lower shoulders 18' at which time the lugs are "clicked" in place.

The present dispenser may be ventless, i.e., may be provided without a vent controlled container vent port as in the U.S. Pat. No. 5,615,806 dispenser, to more positively avoid leakage. For this purpose the product is contained within a collapsible bag or the like located within an outer shell, or the container provided for the dispenser is one having a follower piston which, as known, inwardly shifts during the dispensing of product from the container to continually reduce the product volume of the container.

The dispenser according to the invention is capable of dispensing products of various viscosities such as facial creams, make-up, liposomes, special soaps for mechanics, highly viscous gels, liquid gloves, medicinal gels, etc. The dispenser is also suitable for dispensing hydrogen peroxide, mercromina, iodine and, in general any product that is currently supplied by drip-feeds due to a lack of fluidity, and also products that contain proteins and medicines distributed in the tube, taking advantage of the "ventless" capability.

Obviously, many other modifications and variations of the present invention are made possible in the light of the above teachings. It is therefore to be understood that within the scope of the appended claims the invention may be practiced otherwise than as specifically described.

What is claimed is:

1. A fluid pump dispenser comprising, a pump body having means for mounting the body on a container of product to be dispensed, the body having a pump cylinder defining a pump chamber, a valve-controlled product inlet passage leading to said chamber, a manually reciprocable pump plunger having a hollow stem defining a discharge passage leading from said chamber, said plunger having a discharge spout on an outer end of said stem, a pump piston mounted on an inner end of said stem for relative sliding movement, said body having a plunger return spring for biasing said plunger into a raised position, means acting between said stem and said piston for limiting the relative sliding movement between discharge open and closed positions, said piston having an annular projection extending toward a lower end of said chamber, a plug element fixedly mounted to said stem at said inner end, said plug element having an outer surface facing said lower end of said chamber, said projection sealingly engaging said plug element in the discharge closed position and being spaced from said plug element in the discharge open position upon the relative sliding movement of the piston, and the outer surface of said plug element sealing the inlet passage closed in a lowered position of said element.

2. The pump dispenser according to claim 1, wherein said piston return spring is mounted within said pump body outside said pump chamber.

3. The pump dispenser according to claim 1, wherein said plug element has an annular seal engageable in said lowered position with a restricted inner diameter of said cylinder at said lower end of said chamber.

4. The pump dispenser according to claim 1, wherein said plug element has a coupling extending into said piston stem at said inner end for fixedly mounting said element to said stem.

5. The pump dispenser according to claim 4, wherein means acting between said coupling and said stem permit a snap-fit engagement therebetween.

6. The pump dispenser according to claim 1, wherein said plunger is freely rotatable about a central axis thereof and has radially extending lug means, an inner liner fixedly mounted in said pump body, an inner wall of said liner having transversely extending upper and lower grooves each presenting a stop shoulder, and said liner having at least one axial groove extending between said upper and lower grooves for the reception of said lug means during plunger reciprocation, said lug means engaging said shoulder of said upper groove in a plunger lock-up position, and said lug means engaging said shoulder of said lower groove in a plunger lock-down position.

7. The pump dispenser according to claim 6, wherein said lug means includes a radially outwardly open notch, said liner having a first axial bead associated with said axial groove, and a second axial bead associated with said shoulder of said upper groove, said notch engaging said first bead during plunger reciprocation for positively retaining said lug means thereat, and said notch engaging said second bead in said plunger lock-up position for positively retaining said lug means thereat.

8. The pump dispenser according to claim 6, wherein said shoulder of said lower groove has a resilient protrusion with which said notch engages in said plunger lock-down position for positively retaining said lug means thereat.

9. The pump dispenser according to claim 7, wherein said second bead is adjacent said shoulder of said lower groove, said notch engaging said second bead in said plunger lock-down position for positively retaining said lug means thereat.

* * * * *